United States Patent [19]

Haak et al.

[11] 4,064,790

[45] Dec. 27, 1977

[54] DUAL RADIAL PISTON PUMP OR MOTOR

[75] Inventors: Willard Q. Haak, Peoria; Guy C. Carlson, Jr., both of East Peoria, Ill.

[73] Assignee: Caterpillar Tractor Co., Peoria, Ill.

[21] Appl. No.: 621,929

[22] Filed: Oct. 14, 1975

[51] Int. Cl.[2] ..... F01B 13/04

[52] U.S. Cl. ..... 91/492

[58] Field of Search ..... 91/490, 491, 493, 492

[56] References Cited

U.S. PATENT DOCUMENTS

| | | | |
|---|---|---|---|
| 2,186,556 | 1/1940 | Robbins | 91/497 |
| 2,844,104 | 7/1958 | Wennberg | 91/485 |
| 3,225,701 | 12/1965 | Griffith | 91/496 |
| 3,274,946 | 9/1966 | Simmons | 91/490 |
| 3,742,818 | 7/1973 | Engel | 91/490 |

*Primary Examiner*—William L. Freeh

*Attorney, Agent, or Firm*—Phillips, Moore, Weissenberger, Lempio & Majestic

[57] ABSTRACT

A radial piston pump comprises a housing having a drive shaft rotatably mounted therein and a pair of longitudinally spaced pumps each having a rotor thereof operatively connected to the shaft for rotation therewith. Each pump further comprises a pintle valve mounted in the housing and having a respective rotor rotatably mounted thereon for communicating fluid from an inlet of the housing to an outlet thereof. Each pump further comprises a plurality of circumferentially spaced and radially extending pistons secured thereon with each of the pistons having a cylinder reciprocally mounted on an end thereof for pumping fluid from the inlet to the outlet upon rotation of the rotor which is mounted in eccentric relationship relative to a chamber formed in the housing.

10 Claims, 5 Drawing Figures

DUAL RADIAL PISTON PUMP OR MOTOR

BACKGROUND OF THE INVENTION

Radial piston pump and motors comprise a pintle valve having a rotor rotatably mounted thereon and a plurality of pistons secured to the rotor and disposed circumferentially thereabout. A closed cylinder is reciprocally mounted on the end of each of the piston means for communicating pressurized fluid to an outlet of the pump upon rotation of the rotor which is eccentrically mounted relative to an internal chamber defined by internal wall portions having the cylinders maintained in sliding bearing contact therewith. Any such pumps must exhibit a sufficiently high degree of structural integrity to enable them to operate at high speeds as high as 10–12 m. rpm. In addition, it is further desirable that the pump or motor be constructed and arranged to facilitate economical manufacture and expeditious assembly and disassembly for servicing purposes.

SUMMARY OF THIS INVENTION

An object of this invention is to provide a non-complex and economical dual radial piston pump or motor which is capable of high speed operations for assuring sufficient capacity for a wide variety of applications. The apparatus of this invention comprises a housing having a shaft rotatably mounted therein and a pair of longitudinally spaced pump means each mounted in a cylindrical chamber defined in the housing for selectively pumping fluid from an inlet to an outlet thereof.

Each pump means comprises pintle valve means mounted in the housing and a rotor operatively connected to the shaft for rotation therewith and rotatably mounted on the pintle valve means. A plurality of circumferentially spaced and hollow piston means are secured on the rotor and a cylinder means is reciprocally mounted on the end of each of the piston means for pumping fluid to the outlet of the housing upon rotation of the rotor. In the preferred embodiment of this invention, a single inlet communicates fluid to both of the pump means and a single outlet is employed for each of the pump means.

BRIEF DESCRIPTION OF THE DRAWINGS

Other objects of this invention will become apparent from the following description and accompanying drawings wherein.

DETAILED DESCRIPTION

Figure 1:
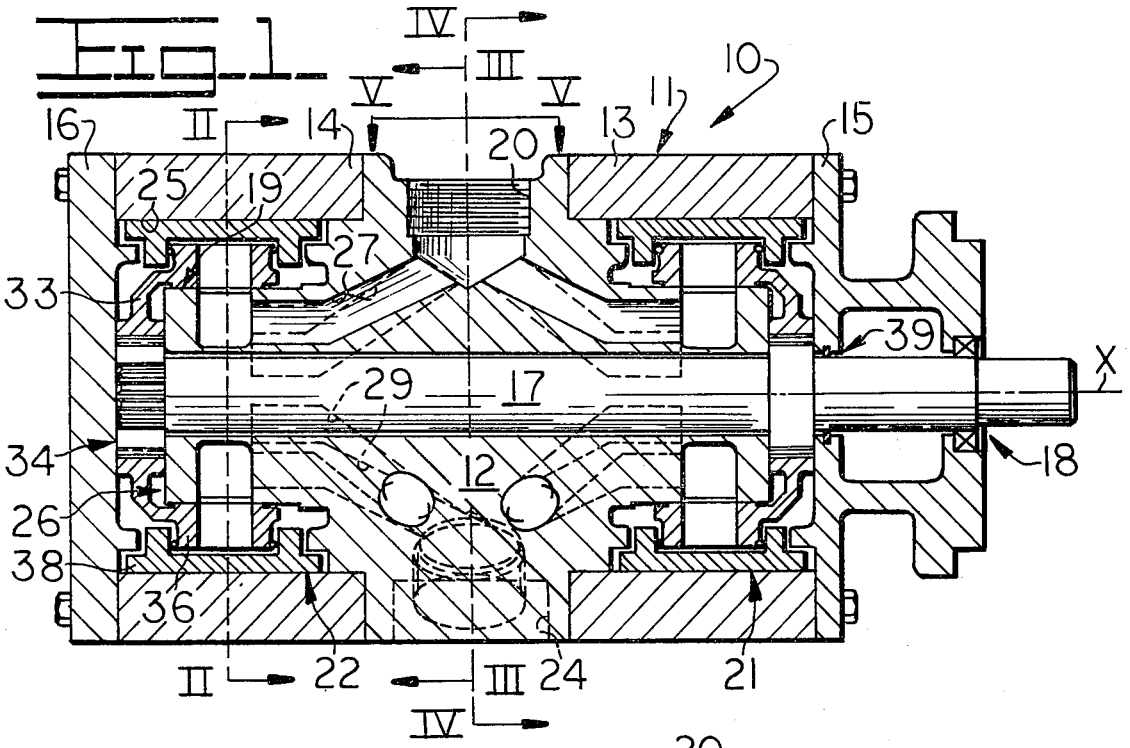
FIG. 1 is a longitudinal sectional view of a dual radial piston apparatus embodying this invention.

FIG. 1 illustrates an apparatus 10 which may constitute a dual radial piston pump or motor, depending on the direction of fluid flow therethrough. The apparatus comprises a housing 11 including a main body portion 12, a pair of cylindrical spacer members 13 and 14 axially abutting a central annular boss of portion 12 and a pair of end plates 15 and 16 suitably attached to respective ends of the housing. A single shaft 17 is rotatably mounted in the housing on an annular bearing means 18 for rotation about a longitudinal axis X thereof. An annular hydrostatic-hydrodynamic bearing 19 is provided at a cylindrical space between the hereinafter described pintle valve and rotor attached to the shaft to thus provide substantial support for the shaft upon rotation thereof.

In pump applications, a single threaded inlet means 20 is suitably defined in the housing for communicating hydraulic fluid thereto upon its connection to an inlet conduit, not shown. A pair of longitudinally spaced pump means 21 and 22 are adapted to pump fluid from the inlet to outlets 23 and 24, respectively. Since the pump means are substantially identical in their constructions and arrangements, only the specific details of pump means 22 will be described in detail hereinafter.

Figure 2:
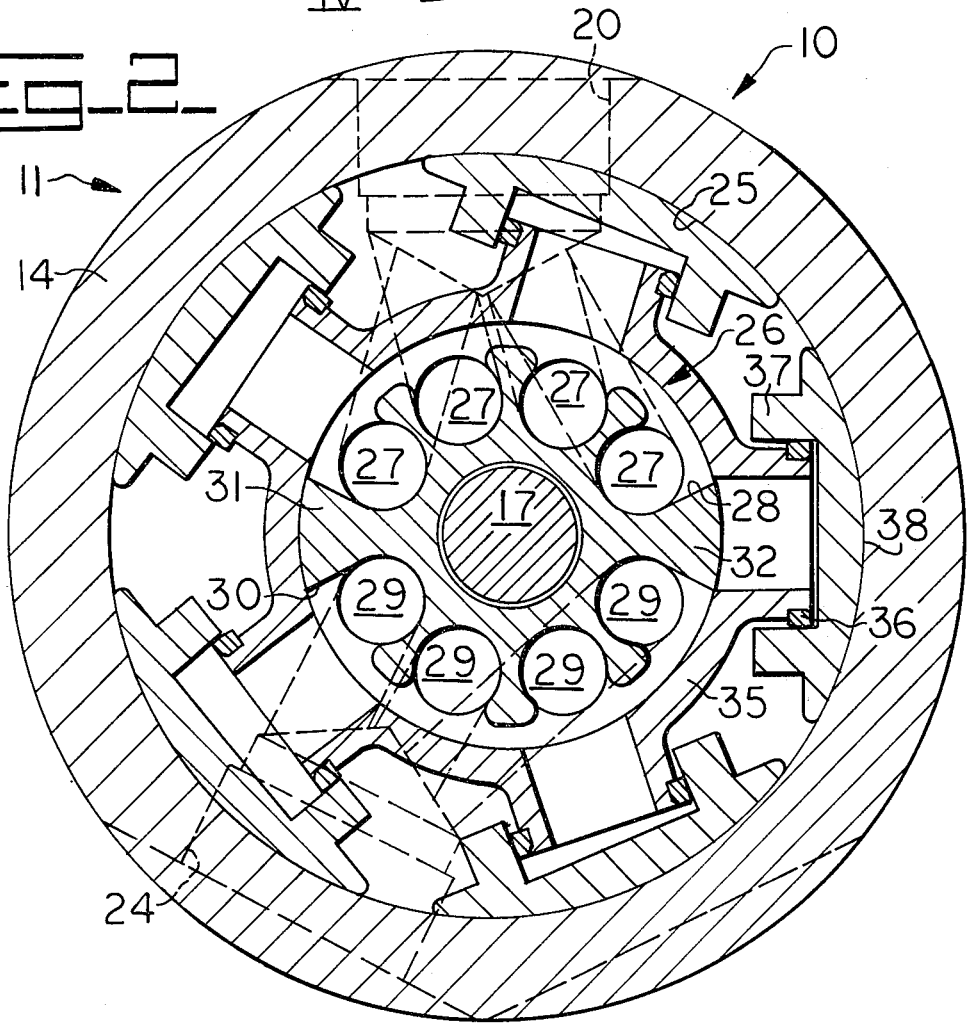
FIG. 2 is a transverse cross sectional view of the apparatus, taken in the direction of arrows II—II in FIG. 1.
Figure 3:
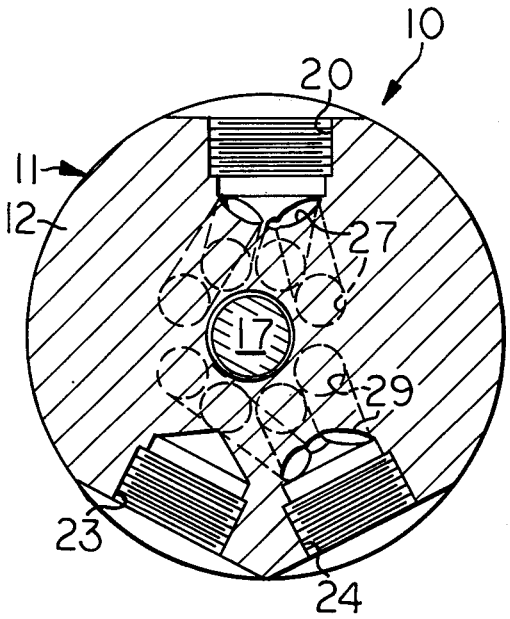
FIGS. 3 and 4 are cross sectional views of the apparatus taken in the direction of arrows III—III and IV—IV in FIG. 1, respectively.
Figure 4:
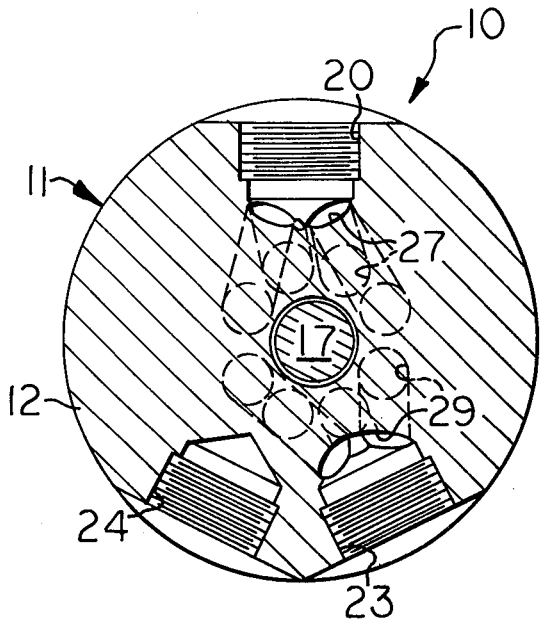
Figure 5:
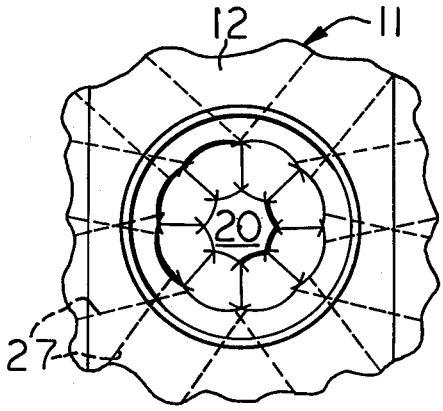
FIG. 5 is a fragmentary top plan view taken in the direction of arrows V—V in FIG. 1.

Referring to FIG. 2, pump means 22 is mounted in a cylindrical chamber 25 defined by wall portions formed internally on member 14 of the housing. A pintle valve means 26 is mounted in the housing and preferably forms a lateral extension of main body portion 12 thereof to communicate with inlet means 20 via four separate first passage means 27 (FIGS. 2 and 5) which terminate at a semi-cylindrical first chamber 28 of the pintle valve means. Four separate second passage means 29, also suitably formed in main body portion 12 of the housing, communicate a second semi-cylindrical chamber 30 of the pintle valve means with outlet 24 (FIGS. 3 and 4). It should be noted that chambers 28 and 30 of the pintle valve are isolated by diametrically opposed partitions 31 and 32 of the pintle valve.

The pump means further comprises a rotor 33 which is operatively connected to a first end of shaft 17 at a spline connection 34 and is disposed interiorly of housing 11. It should be noted that the rotor of the second pump means is operatively connected between the first and a second end of the shaft which projects exteriorly of the housing. Rotor 33 is cup-shaped to comprise a cylindrical portion 35 mounted by hydrostatic bearing 19 on the pintle valve means in eccentric relationship relative to chamber 25. As is well known in the art, pressurized fluid can thus be communicated to the outlet means upon rotation of the rotor.

The pump further comprises a plurality of circumferentially spaced and hollow piston means 36 secured on the rotor to extend radially outwardly therefrom. A cylinder means 37 is reciprocally mounted on the end of each of the piston means and has an arcuate bearing face 38 on the closed outer end thereof. The bearing face engages internal wall portions defining cylindrical chamber 25 in sliding bearing contact therewith.

From the above description it can be seen that rotation of shaft 17 will rotate rotors 33 of pump means 21 and 22 to thus reciprocate cylinder means 37 thereof relative to pistons 36. Fluid communicated to first chamber 28 of the pintle valve means will thus be pumped into second chamber 30 thereof and to outlets 23 and 24 via second passage means 29. An annular dynamic seal 39 may be mounted on end plate 15 of the housing to engage a periphery of shaft 17 for sealing purposes. As mentioned above, it should be understood that the above-described pump could be utilized as a motor by reversing the fluid flow therethrough, i.e., to communicate pressurized fluid from a source, not shown, and into outlets 23 and 24 for effecting rotation of shaft 17.

We claim:

1. A dual radial piston apparatus comprising a housing, a single shaft mounted in said housing for rotation about a longitudinal axis thereof, inlet means defined in said housing for communicating fluid therein, outlet means defined in said housing for communicating fluid therefrom, and a pair of longitudinally spaced pump means each mounted in a cylindrical chamber defined in said housing, each of said pump means comprising pintle valve means mounted in said housing and communicating with said inlet means via first passage means and with said outlet means via second passage means, a cup-shaped rotor operatively connected to said shaft at a spline connection for rotation therewith, whereby the rotor of each of said pump means is connected to said single shaft, and rotatably mounted on said pintle valve means in eccentric relationship relative to said chamber for communicating fluid from said first passage means to said second passage means upon rotation of said rotor, a plurality of circumferentially spaced and hollow piston means secured on said rotor to extend radially outwardly therefrom and a cylinder means reciprocally mounted on the end of each of said piston means and disposed in sliding bearing contact internally of said chamber for pumping fluid through said second passage means and to said outlet means upon rotation of said rotor.

2. The apparatus of claim 1 further comprising annular bearing means solely mounting one end of said shaft for rotation in said housing and further comprising hydrostatic-hydrodynamic bearing means rotatably mounting said rotor on said pintle valve means.

3. The apparatus of claim 1 wherein the rotor of one of said pump means is operatively connected to a first end of said shaft and is disposed interiorly of said housing and wherein the rotor of the other of said pump means is operatively connected to said shaft between the first and a second end thereof and wherein the second end of said shaft projects exteriorly of said housing.

4. The apparatus of claim 1 wherein said housing comprises a main body portion having the pintle valve means of each of said pair of pump means secured on an end thereof to extend laterally therefrom.

5. The apparatus of claim 4 wherein said housing further comprises a pair of longitudinally spaced cylindrical members mounted on said main body portion to abut an annular boss thereof and wherein a respective one of said chambers is defined by surface portions formed internally on each of said cylindrical members.

6. The apparatus of claim 5 wherein said housing further comprises a cover plate attached to each of said cylindrical members at respective ends of said pump.

7. The apparatus of claim 1 wherein said inlet means constitutes a single inlet formed intermediate the ends of said housing and wherein said outlet means constitutes a pair of circumferentially spaced outlets each of which communicates with a second passage means of a respective one of said pump means.

8. The apparatus of claim 7 wherein said inlet means and said outlet means are disposed in substantial diametrically opposed relationship to each other.

9. The apparatus of claim 7 wherein said first passage means constitute a plurality of separate passages defined in said housing communicating a lower end of said single inlet with a first chamber of said pintle valve means.

10. The apparatus of claim 9 wherein said second passage means constitute a plurality of separate passages defined in said housing for communicating a second chamber of said pintle valve means, isolated from the first chamber thereof, with the single outlet of a respective pump means.

* * * * *